US009207048B1

(12) United States Patent
Roland et al.

(10) Patent No.: US 9,207,048 B1
(45) Date of Patent: Dec. 8, 2015

(54) MULTI-PLY HETEROGENEOUS ARMOR WITH VISCOELASTIC LAYERS AND HEMISPHERICAL, CONICAL, AND ANGLED LAMINATE STRIKEFACE PROJECTIONS

(71) Applicants: Charles M. Roland, Waldorf, MD (US); Daniel M. Fragiadakis, Alexandria, VA (US); Raymond M. Gamache, Indian Head, MD (US)

(72) Inventors: Charles M. Roland, Waldorf, MD (US); Daniel M. Fragiadakis, Alexandria, VA (US); Raymond M. Gamache, Indian Head, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/207,339

(22) Filed: Mar. 12, 2014

Related U.S. Application Data

(63) Continuation-in-part of application No. 13/085,130, filed on Apr. 12, 2011.

(60) Provisional application No. 61/787,593, filed on Mar. 15, 2013, provisional application No. 61/322,963, filed on Apr. 12, 2010.

(51) Int. Cl.
*F41H 5/04* (2006.01)

(52) U.S. Cl.
CPC ..... *F41H 5/0492* (2013.01)

(58) Field of Classification Search
CPC ... F41H 5/0492; F41H 5/0442; F41H 5/0407; F41H 5/0414; F41H 5/0471; F41H 5/0457; F41H 5/0464; F41H 5/0421; F41H 5/0428; F41H 5/04
USPC ..... 89/36.02
See application file for complete search history.

(56) References Cited

U.S. PATENT DOCUMENTS

| | | | | |
|---|---|---|---|---|
| 848,024 | A * | 3/1907 | Gathman | 114/10 |
| 1,035,573 | A * | 8/1912 | Gathman | 114/10 |
| H001061 | H * | 6/1992 | Rozner et al. | 89/36.02 |
| 5,970,843 | A * | 10/1999 | Strasser et al. | 89/36.02 |
| 6,200,664 | B1 * | 3/2001 | Figge et al. | 428/178 |
| 7,300,893 | B2 * | 11/2007 | Barsoum et al. | 442/134 |
| 7,557,054 | B2 * | 7/2009 | Oda et al. | 501/90 |
| 7,562,612 | B2 * | 7/2009 | Lucuta et al. | 89/36.02 |
| 2002/0012768 | A1 * | 1/2002 | Cohen | 428/117 |
| 2005/0235818 | A1 * | 10/2005 | Lucuta et al. | 89/36.02 |
| 2006/0201318 | A1 * | 9/2006 | LaBrash et al. | 89/36.02 |
| 2007/0017359 | A1 * | 1/2007 | Gamache et al. | 89/36.04 |
| 2008/0236378 | A1 * | 10/2008 | Sane et al. | 89/36.02 |
| 2010/0212484 | A1 * | 8/2010 | Williams et al. | 89/36.02 |
| 2011/0067561 | A1 * | 3/2011 | Joynt | 89/36.02 |
| 2012/0055326 | A1 * | 3/2012 | Cohen | 89/36.02 |
| 2014/0305295 | A1 * | 10/2014 | Sobczak et al. | 89/36.02 |
| 2014/0305296 | A1 * | 10/2014 | Sobczak et al. | 89/36.02 |

* cited by examiner

*Primary Examiner* — Joshua Freeman
(74) *Attorney, Agent, or Firm* — US Naval Research Laboratory; Sally A. Ferrett

(57) ABSTRACT

An armor system with a composite laminate having at least four alternating layers (two bi-layers) of a first material and a second material, the first material having a lower acoustic impedance than the second material. The first material is a viscoelastic polymer with a glass transition temperature less than the expected operational temperature range, and the second material can be a hard material such as steel, aluminum, or ceramic. The laminate can include many alternating layers of elastomer and hard material, and can be adhered or affixed to a thicker armor substrate. The second material layer can be a layer of hollow or solid spheres. Additional protective elements such as front surface hemispheres or conical projections, and corrugated panels can be added to improve resistance to armor piercing rounds, explosively formed penetrators, or other threats.

10 Claims, 14 Drawing Sheets

EFFECT OF FRONT-SURFACE ELASTOMER LAYERS ON BALLISTIC LIMIT OF STEEL PLATES

| CONSTRUCTION | STEEL LAYERS (MM) | ELASTOMER LAYERS (MM) | AREAL DENSITY (KG/M$^2$) | V-50 (M/S) |
|---|---|---|---|---|
| SINGLE LAYER | ONE 12.7[a] | NONE | 99 | 1097± 15 |
| SINGLE LAYER | ONE 12.7[b] | NONE | 99 | 1184± 5 |
| BI-LAYER | ONE 12.7[b] | ONE 12.7 | 113 | 1483± 7 |
| FOUR LAYERS | TWO 6.4[b] | TWO 6.4 | 113 | 1819± 2 |
| EIGHT LAYERS | FOUR 3.2[b] | FOUR 3.2 | 113 | 1579± 7 |

[a] ROLLED HOMOGENEOUS ARMOR
[b] HIGH HARD STEEL

FIG. 7A

EFFECT OF ELASTOMER LAYERS ON BALLISTIC LIMIT AT REDUCED LAMINATE WEIGHT

| CONSTRUCTION | HHS LAYERS (MM) | ELASTOMER LAYERS (MM) | AREAL DENSITY (KG/M$^2$) | V-50 (M/S) |
|---|---|---|---|---|
| SINGLE LAYER | ONE 12.7 | NONE | 99 | 1184± 5 |
| BI-LAYER | ONE 12.7 | ONE 6.4 | 106 | 1365± 6 |
| FOUR LAYERS | TWO 5.1 | TWO 3.2 | 86 | 1398± 7 |
| FOUR LAYERS | TWO 5.3 | TWO 3.2 | 90 | 1457± 1 |

FIG. 7B

EFFECT OF LAMINATION OF ELASTOMER COATING ON BALLISTIC PERFORMANCE

| CONSTRUCTION | HHS LAYERS (MM) | ELASTOMER LAYERS | AREAL DENSITY (KG/M$^2$) | V-50 (M/S) |
|---|---|---|---|---|
| SINGLE LAYER | ONE 11.5[a] | NONE | 90 | 999± 8 |
| SINGLE LAYER | ONE 5.3[b] | NONE | 42 | 662± 7 |
| 21 LAYERS | ONE 5.3[b] | 6.1 MM TOTAL (21 SOFT) | 48 | 896± 1 |
| 21 LAYERS | ONE 5.3[b] | 6.1 MM TOTAL (11 SOFT/10 HARD) | 51 | 1006 |

[a] ROLLED HOMOGENEOUS ARMOR
[b] HIGH HARD STEEL

FIG. 7C

MULTI-PLY HETEROGENEOUS ARMOR WITH VISCOELASTIC LAYERS AND HEMISPHERICAL, CONICAL, AND ANGLED LAMINATE STRIKEFACE PROJECTIONS

BACKGROUND

Technical Field

This application is related to energy absorbing materials suitable for armor against projectiles, shape charges, EFPs, and explosives.

Related Technology

Effective armor technologies have been sought for many decades to protect humans, vehicles, and systems against projectile weapons and explosive blasts.

The Air Force Research Laboratory has increased blast resistance of infill composite masonry unit walls by applying an elastomeric coating to the surface of the wall. As described in Porter, J. R., Dinan, R. J., Hammons, M. I., and Knox, K. J., "Polymer coatings increase blast resistance of existing and temporary structures", AMPTI AC Quarterly, Vol. 6, No. 4, pp. 47-52, 2002, the elastomeric coating is a two-component sprayed-on polyurea, and the coating can be applied to the interior and exterior surfaces of the wall, or to only one surface. It functions primarily by reducing fragmentation (flying debris) of the structure destroyed by the blast.

Composite polyurea coatings have been tested for mitigating the damage from ballistic fragmentation and projectiles. For example, Tekalur, S. A, Shukla, A., and Shivakumar, K., "Blast resistance of polyurea based layered composite materials", Composite Structures, Vol. 84, No. 3, pp. 271-81, (2008) discloses test results for layered and sandwiched layers of polyurea and E-glass vinyl ester.

Bogoslovov, R. B., Roland, C. M., and Gamache, R. M., "Impact-induced glass transition in elastomeric coatings", Applied Physics Letters, Vol. 90, pp. 221910-1-221910-3, 2007, which is incorporated by reference herein in its entirety, discloses coating steel with a polybutadiene or polyurea elastomeric layer for impact loading, and compares their failure mechanisms.

Possible mechanisms contributing to the blast and ballistic mitigation of composites are discussed in Xue, Z. and Hutchinson, J. W., "Neck development in metal/elastomer bilayers under dynamic stretchings", International Journal of Solids and Structures, Vol. 45, No. 3, pp. 3769-78, (2008); in Xue, Z. and Hutchinson, J. W., "Neck retardation and enhanced energy absorption in metal-elastomer bilayers", Mechanics of Materials, Vol. 39, pp. 473-487, (2007); and in Malvar, L. J., Crawford, J. E., and Morrill, K. B.; "Use of composites to resist blast", Journal of Composites for Construction, Vol. 11, No. 6, pp. 601-610, (November/December 2007).

A. Tasdemirci, I. W. Hall, B. A. Gama and M. Guiden, "Stress wave propagation effects in two- and three-layered composite material", Journal of Composite Materials, Vol. 38, pp. 995-1009, (2004), discloses tests on a three layered composite material with a layer of EPDM rubber between an alumina tile and a glass epoxy composite plate.

Information on the material properties of viscoelastic materials is found in D.I.G. Jones, Handbook of Viscoelastic Vibration Damping, Wiley, 2001, pp. 39-74.

A review of mechanical behavior of viscoelastic materials can also be found in R. N. Capps, "Young's moduli of polyurethanes", J. Acoustic Society of America, V. 73, No. 6, pp. 2000-2005, June, 1983. In discussing Capps's FIG. 2, Capps discloses that viscoelastic material has four general regions of mechanical behavior: a low temperature, glassy region in which the storage modulus is almost constant; a glass-rubber transition region in which the storage modulus changes remains more or less the same; a rubbery region in which the value of the modulus remains more or less the same; and a flow region in which the values of the modulus drops very rapidly. The behavior in this region is greatly influenced by the molecular weight. For viscoelastic materials, typically the loss tangent is almost constant in the rubbery region, increasing slightly with increasing frequency or decreasing temperature. The onset of the glass-rubber transition can be characterized by a peak in the loss tangent. The loss tangent then decreases until it reaches another plateau, where the loss tangent is again almost constant. The material is then in the glassy region, in which the material has a high storage modulus and a low loss tangent.

BRIEF SUMMARY

An armor system includes a composite laminate with at least four alternating layers of a first elastomeric material and a second material, the first material having a lower acoustic impedance than the second material.

The second material can be ceramic, glass, E glass, or S glass, or a metal such as steel or aluminum. The first material can be a polymer capable of a glass phase transition during a ballistic impact.

The first material can have an acoustic impedance of at least 20% less than the second material. The first material can be a viscoelastomer with a glass transition temperature less than the service temperature of the armor system, and which fails in a glassy fashion upon impact of a high speed projectile. The first material can be polyisobutylene (PIB), butyl rubber, polyurea, nitrile rubber (NBR), 1,2-polybutadiene, polynorbornene, or atatic polypropylene. The first material can be an elastomeric material that shocks up (i.e., shock waves can arise in the material during impact loading). The first material can be non-woven.

The first material is placed in front, in direct contact with the second material, either with an adhesive, mechanically attached, or merely in physical contact with a surface of the second material.

The composite laminate can include at least two alternating layers (one bi-layer) of the first material and the second material, and preferably at least four alternating layers (two bi-layers), or at least six alternating layers (three bi-layers), or more.

The composite laminate can be affixed to an armor substrate. The armor substrate can have a hardness of at least 300 Brinell units, and preferably, has a hardness in the range of 470-600 Brinell units with a certain level of toughness.

The armor system can also include a corrugated metal panel with ceramic panels adhered to a corrugated face of the metal panel, the corrugated panel positioned with the ceramic panels facing away from the composite laminate. The corrugated panel can be spaced apart at least two inches from the composite laminate.

The armor system can also include at least two layers of cylindrical armor elements positioned on one face of the composite laminate, the cylindrical armor elements formed of a metal or composite cylinder filled with compressed glass and capped on both ends. The compressed glass can be ceramic, borosilicate or soda-lime glass. The cylindrical armor elements can also include at least one elastomer layer and at least one metal layer placed either around or behind the cylindrical armor.

An armor system can include a plurality of cylindrical armor elements, each cylindrical armor element including a sealed cylindrical metal casing containing compressed glass.

The cylindrical metal casing can be capped on both ends. The cylindrical armor element can be formed by heating the cylindrical metal casing, pressing the glass into the cylindrical metal casing, and sealing the cylindrical metal casing while the glass and metal casing are hot.

The glass can be ceramic, borosilicate, or soda-lime glass. The armor system can be arranged with at least two layers of parallel cylindrical armor elements, and can include at least one plate or laminate armor element positioned behind the layers of parallel cylindrical armor elements. The cylindrical armor elements can also include at least one bi-layer coating on the cylindrical metal casing with at least one elastomer layer and at least one hard layer.

BRIEF DESCRIPTION OF THE DRAWINGS

FIG. 7A-7C show the V-50 ballistic limit for several different laminate armors.

DETAILED DESCRIPTION OF EMBODIMENTS OF THE INVENTION

Figure 1:
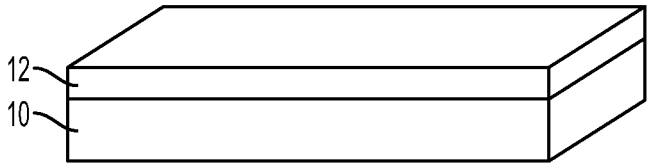
FIG. 1 illustrates a high hardness steel plate with an elastomeric coating.

FIG. 1 illustrates a high hardness steel (HHS) plate 10 coated with an elastomeric coating 12.

The elastomeric coating can be one or more of a high molecular weight, commercial organic polymer such as, but not limited to: polyisobutylene (PIB); butyl rubber; different variations of polyurea; polynorbornene (PNB); nitrile rubber (NBR); 1,2-polybutadiene (PB); and atactic polypropylene. The compounds are all applied to the front face of the hard substrate.

The hard substrate can be high hardness steel (HHS) in accordance with MIL-A-46100, with hardness in the range of 470-600 Brinell units. Substrates with a lower hardness can be used but a decrease in penetration resistance performance will occur. Preferably, the substrate materials combine hardness with toughness (resistance to shattering when impacted).

An adhesive can be used to adhere the coating to the substrate, although mechanical means of attachment can also be suitable.

Steel plates with elastomeric coatings were subjected to ballistics tests of MIL-STD-662F, using a 50 caliber (1.3 cm diameter) rifled Mann barrel firing fragment-simulating projectiles (FSP). The projectiles had a Rockwell-C hardness of 30. The velocity of the projectile, varied by variations of the gunpowder charge, was measured with chronographs and/or a laser velocimeter. The thickness of the steel plates for testing is between 5.1 and 12.7 mm, in all cases sufficient to prevent observable flexure upon ballistic impact.

Figure 2:
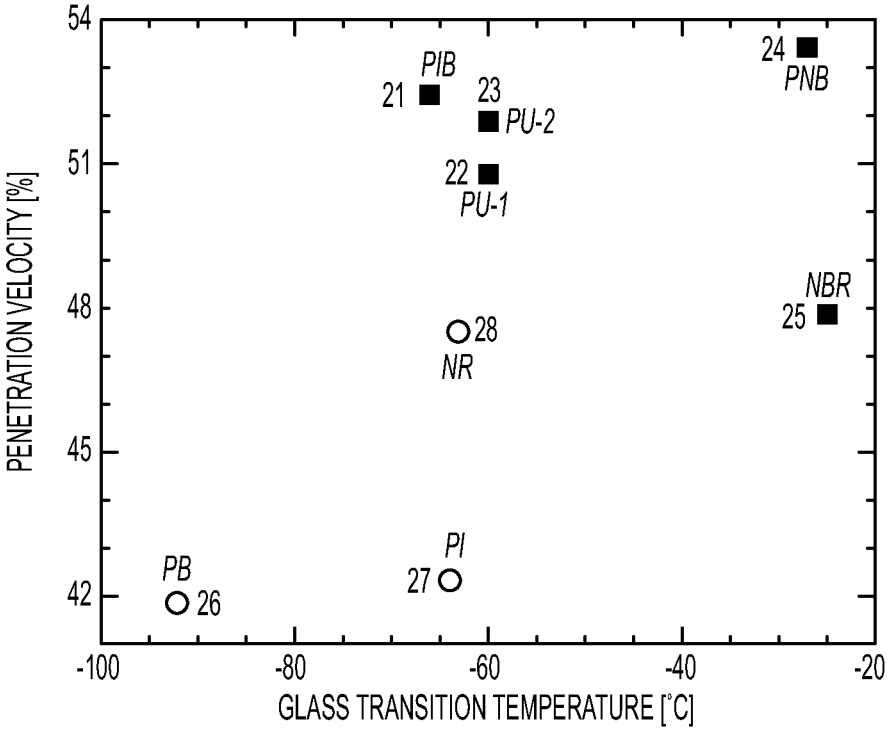
FIG. 2 is a graph of the increase in ballistic limit for an HHS steel plate coated with an elastomer over the ballistic limit for bare HHS versus the glass transition temperature for the elastomeric coating.

FIG. 2 compares HHS steel plates, each plate coated with an elastomeric coating, to a bare HHS steel plate. Specifically, FIG. 2 plots the increase in ballistic limit for an HHS steel plate coated with an elastomer over the ballistic limit for bare HHS versus the glass transition temperature for the elastomeric coating.

The ballistic limit (i.e., penetration limit) is the velocity required for this projectile to reliably penetrate a particular piece of armor. The V-50 ballistic limit is the velocity at which the projectile is expected to penetrate the armor 50% of the time. In this test, the V-50 is determined as the average of the lowest velocity for complete penetration and highest velocity for partial penetration, with the testing carried out until these quantities differed by no more than 15 m/s. The projectile velocity is determined using two pairs of tandem chronographs and allowing the velocity to be measured at the same position.

Low frequency stress strain data on the elastomers are obtained in a tensile geometry using an Instron 550R. The glass transition temperatures are measured by scanning calorimetry (with a TA Instruments Q100), with samples cooled below the glass transition temperature $T_g$ at a rate of 10 degrees Kelvin per minute and data taken subsequently heating at the same rate.

HHS steel plates were coated with polyisobutylene (PIB), butyl rubber, two variations of elastomeric polyurea (PU-1 and PU-2), polynorbornene (PNB), nitrile rubber (NBR), 1,4-polybutadiene (PB), synthetic 1,4 polyisoprene (PI), and natural 1,4 polyisoprene (NR), respectively. The HHS steel is formed in accordance with MIL-A-46100. Ballistic testing was accomplished according to MIL-STD-662F against .50 caliber fragment simulating projectiles.

In FIG. 2, the HHS steel plates coated with polyisobutylene (PIB) 21, the PU-1 polyurea 22, the PU-2 polyurea 23, the polynorbornene (PNB) 24, and the nitrile rubber (NBR) 25, are each shown with a solid square, indicating that they failed in a brittle fashion, with the damage zone limited to the immediate area of impact. The 1,4-polybutadiene (PB) 26, the synthetic (PI) 1,4 polyisoprene 27 and natural rubber (NR) 1,4 polyisoprene 28 experienced rubbery failure, with substantial tearing and stretching of the coating.

For example, the 1,4-polybutadiene (PB) 26 deforms in typical rubbery fashion—a high level of strain, with the deformation very delocalized. In contrast, the PU materials 22, 23 shatter in a brittle fashion upon impact, with minimal stretching of the rubber, and small residual damage.

The glass transition temperature of the material is believed to be a significant factor in achieving a high ballistic limit. When the glass transition temperature is less than, but sufficiently close to, the operational temperature, the impact of the projectile induces a transition to the viscoelastic glassy state. The transition to the viscoelastic glassy state is accompanied by large energy absorption and brittle fracture of the rubber, which significantly reduces the kinetic energy of the projectile and hence its ability to penetrate the armor.

Note that conventionally it has been considered that brittle fracture is associated with minimal energy dissipation. However, in the case of projectile impact on certain elastomeric coatings over hard substrates, the brittle glass is the consequence of deformation that encompasses the glass transition zone. Thus, the energy dissipation is substantial.

An additional key factor in the ballistic resistance of the elastomeric-coated steel involves the energy spreading of the impact area. Mechanisms such as mode conversion and strain delocalization, enable broadening of the impact area reducing the impact pressure.

Referring again to FIG. 2, the PNB, PIB, PU-2, PU-1, and NBR coated HHS materials each failed in a brittle fashion, thus, PNB, PIB, PU-2, PU-1, and NBR are believed to be good choices for coating plates for ballistic resistance.

Note that the glass transition temperatures for the PIB and PU coatings are approximately −60 degrees C., so are not especially high. However, the impact still induces a glass transition. The glass transition may occur because the transition zone is unusually broad for these polymers, as discussed in the following paragraphs in more detail.

Figure 3A:
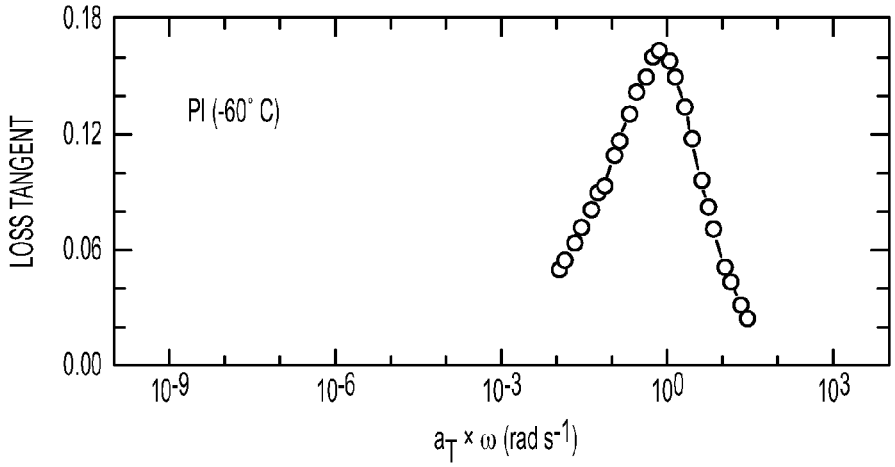
FIGS. 3A, 3B, and 3C show the measured loss tangent versus reduced frequency for polyisoprene (PI), polyisobutylene (PIB), and a polyurea, respectively.
Figure 3B:
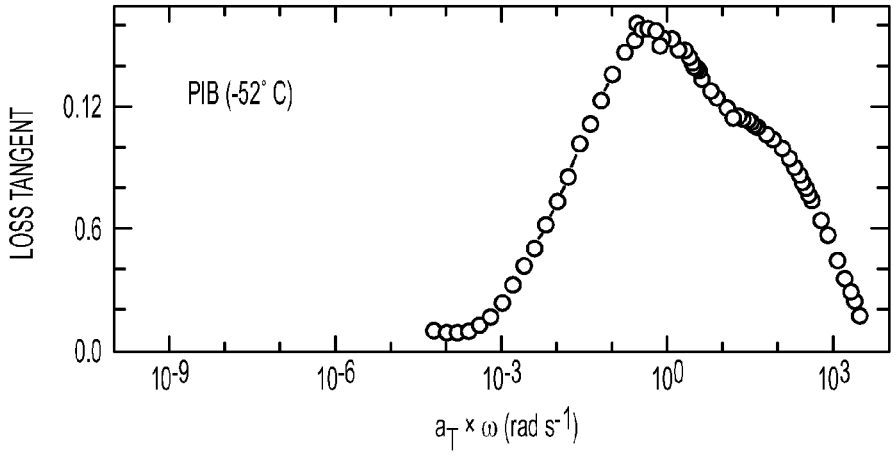
Figure 3C:
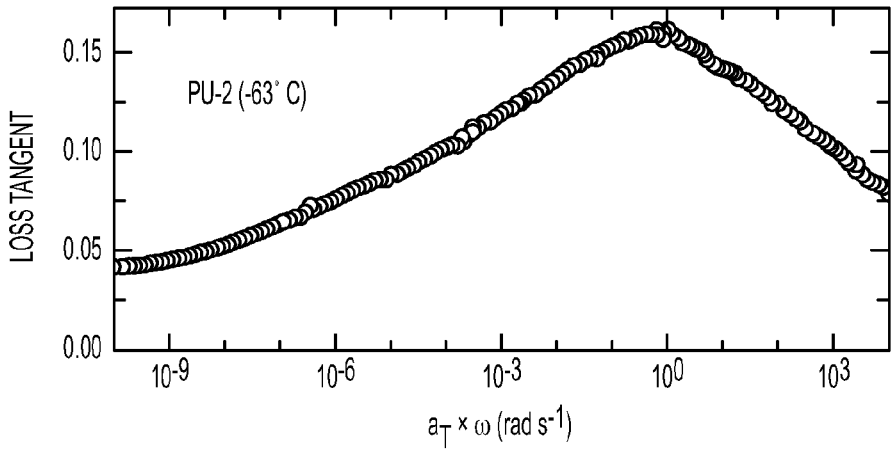

FIGS. 3A, 3B, and 3C, show the mechanical loss tangent for PI, PIB, and PU-2, respectively, plotted against the reduced frequency $\alpha_T \times \omega$ in 1/rad, in which $\omega$ is frequency in radians, and $\alpha_T$ is the shift factor in a shift factor equation for modeling the frequency and temperature equivalence of viscoelastic materials, such as the Williams-Landel-Ferry (WLF) equation, the Vogel-Fulcher equation, or another shift factor equation.

The reduced frequency $\alpha_T \times \omega$ takes into account both the frequency and temperature. At the high temperature/low frequency portion at the right of each plot, the materials exhibit rubbery properties. At the low temperature/high frequency portion at the left of each plot, the materials exhibit glassy properties. A transitional region lies between the rubbery and glassy regions.

The curve in FIG. 3C for PU-2 is the superposition of measurements over a range of temperature. Although the PU-2 material is thermo-rheologically complex and the shape of the superposed curve is only approximate, the time-temperature superpositioning gives an indication of the breadth of the dispersion. For FIG. 3B, the data for the polyisobutylene (PIB) curve was obtained over a broad frequency range by combining transient and dynamic mechanical spectroscopies. In the FIG. 3A curve for 1,4-polyisoprene (PI), the dispersion is narrow, and can be measured in a single experiment without time-temperature superpositioning. The height of the loss tangent peak varies with temperature, specifically by decreasing with proximity to $T_g$, which is believed to be a consequence of the thermo-rheological complexity.

Figure 4:
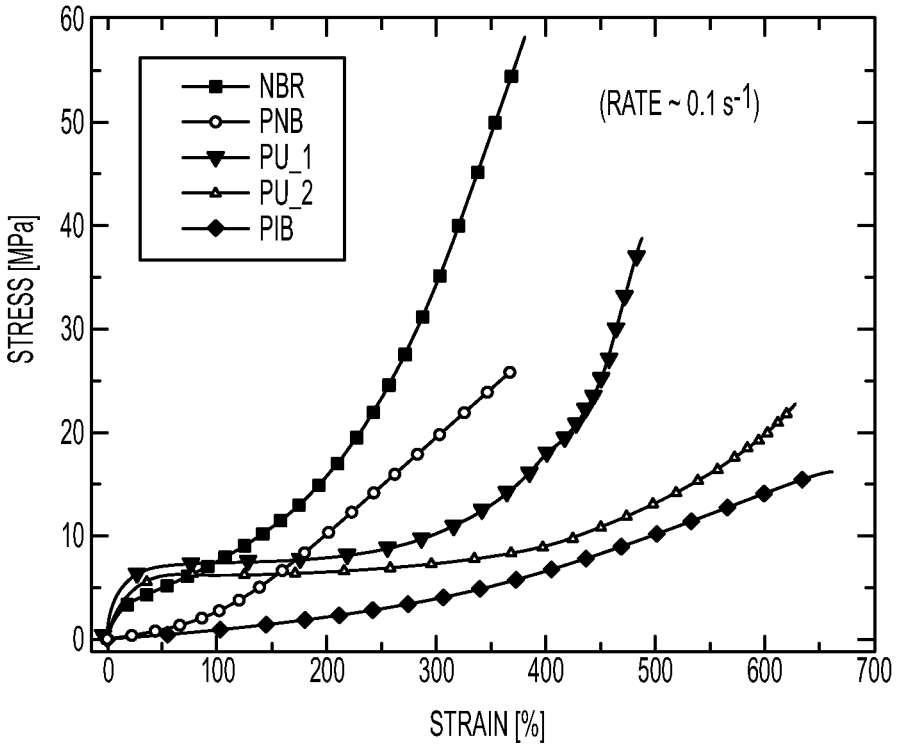
FIG. 4 shows the stress versus strain measured at low rates of strain for several different viscoelastic materials.

FIG. 4 is a plot of uniaxial extension measurements for the NBR, PNB, PU-1, PU-2, and PIB elastomers that perform well as ballistic coatings on HHS steel. Note that the conventional mechanical properties such as stiffness, strength, and toughness, measured at conventional, slow, laboratory strain rates bear little or no relationship to the materials' ability to enhance the penetration resistance of armor. For example, FIG. 4 shows that the polyurea compounds differ by a factor of two in strength, but have quite modest differences in performance as a coating, as shown in FIG. 2. In fact, a slightly higher V-50 ballistic limit is obtained with the lower strength PU-1 coating on HHS.

It appears that there are two reasons for the decoupling of rubber properties and armor coating performance. First, the viscoelastic behavior of the materials is different, so their response to changes in strain rate can be quite different. Secondly, and more importantly, substantial increases in the ballistic limit of the armor are associated with an impact-induced transition to the glassy state. The transition to the glassy state is related to the glass transition temperature $T_g$ of the elastomer, whereas generally the mechanical properties of rubbers measured at conventional strain rates are not.

The best-performing viscoelastic coatings for layering with a hard armor layer are believed to be those with a glass transition temperature ($T_g$) that is less than, but close to, the environmental temperature at which the armor operate. For example, for testing at room temperature, materials with a glass transition lower than ca. 21 degrees Celsius.

It appears that clamping methods are not a very important factor in the penetration resistance for these composite materials, as long as the viscoelastic polymer has a high degree of direct physical contact with the hard substrate. For example, for a PIB coating attached to a 6.2 mm HHS substrate with an adhesive, the V-50 was measured to be 869 m/s. A PIB coating attached to the 6.2 mm thick HHS substrate with mechanical fasteners demonstrated a V-50 ballistic limit of 855 mm. Similarly, an NBR coating attached to a 6.2 mm HHS substrate with an adhesive demonstrates a V-50 ballistic limit of 848 m/s, compared to an NBR coating attached to the 6.2 mm HHS substrate with mechanical fasteners having a measured V-50 of 852 m/s. Thus, the attachment method appears to have very little effect on the penetration resistance. When the polymer is in physical contact with the steel substrate, the projectile impact compresses the viscoelastic material, rather than causing flexure in the viscoelastic material. An implication is that the hyper-elastic response of the steel is largely independent of the coating, other than encountering a projectile of reduced velocity after passage of the projectile through the dissipative rubber.

Figure 5:
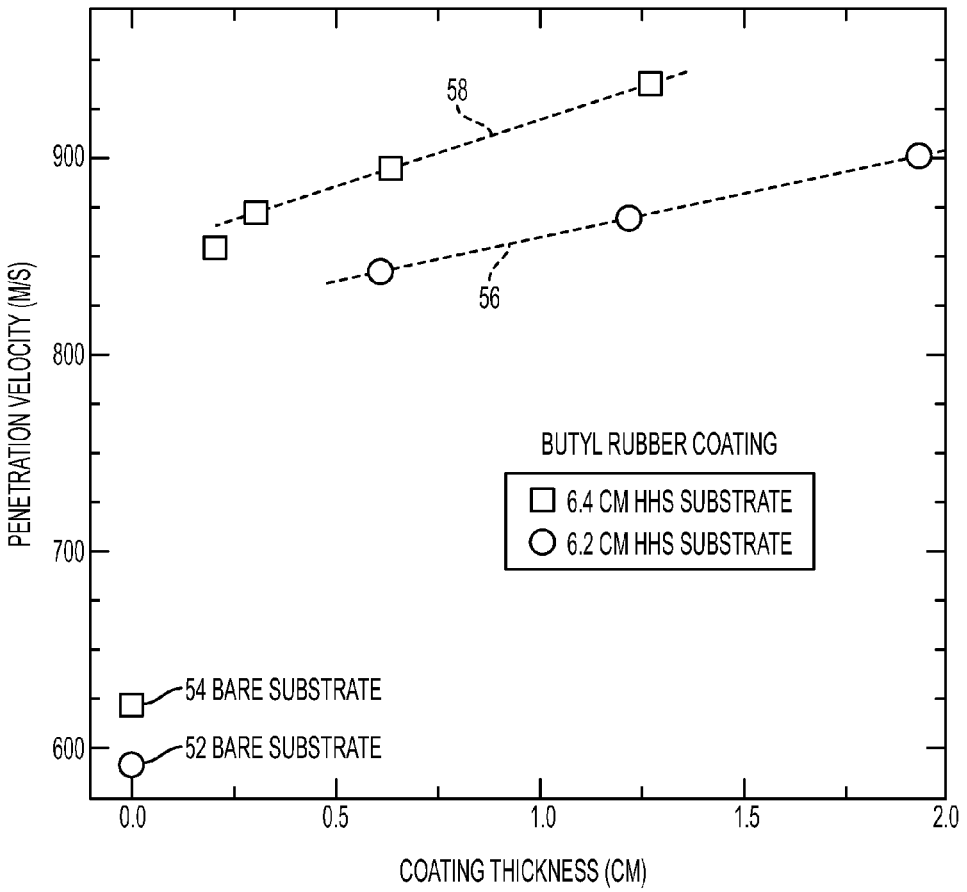
FIG. 5 is a graph showing penetration velocity versus coating thickness for a PIB coating on two different thicknesses of HHS (High Hard Steel) substrate.

Thickness is an important consideration in designing armor. In most applications, armor involves a compromise between performance and weight. FIG. 5 shows the variation in V-50 for two steel plates as a function of the thickness of the PIB coating. Two data sets are shown, corresponding to HHS substrates of 6.4 mm and 6.2 mm, respectively. The bare 6.2 mm thick HHS substrate 52 and the bare 6.4 mm thick HHS substrate 54 have a lower V-50 penetration velocity than the coated substrates. The curve 56 for the coated 6.2 mm HHS and the curve 58 for the coated 6.4 mm HHS have modest slopes (170±4 and 114±2 m/s for the PIB coated 6.4 and 6.2 mm thick HHS substrate, respectively), corresponding to a change in V-50 of less than 200 m/s per centimeter of coating. This insensitivity to thickness is maintained down to approximately 0.3 cm viscoelastic coating thickness. Extrapolating along the curves 56 and 58 to a zero thickness provides V-50 estimates that are more than 50% higher than were actually measured for the bare HHS plates. It can be concluded that the surface of the coating dissipates a large portion of the projectile kinetic energy. This near invariance of resistance to penetration to thickness is exploited in the multi-laminate structures illustrated in FIG. 6A-6E.

Figure 6A:
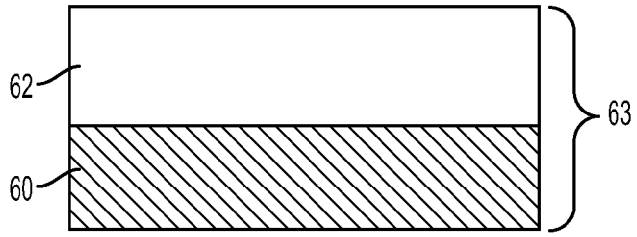
FIG. 6A is a cross sectional view of a laminate armor structure with one layer of HHS and one elastomeric layer.

FIG. 6A is a cross sectional view of a laminate armor structure with one layer of aluminum and one elastomeric layer. Thus, the structure has one bi-layer 63.

Figure 6B:
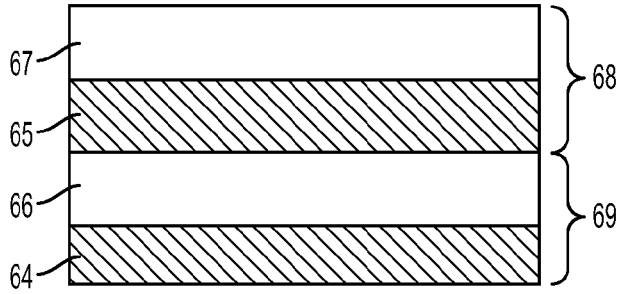
FIG. 6B shows a laminate armor structure with two layers of HHS and two elastomeric layers.

FIG. 6B shows a laminate armor structure with two layers of HHS 64, 65 and two 6.4 mm elastomeric layers 66,67, with the aluminum and elastomeric layers alternating. Thus, the armor structure of FIG. 6B has two bi-layers 68, 69, with each bi-layer having an aluminum layer and an elastomeric layer.

Figure 6C:
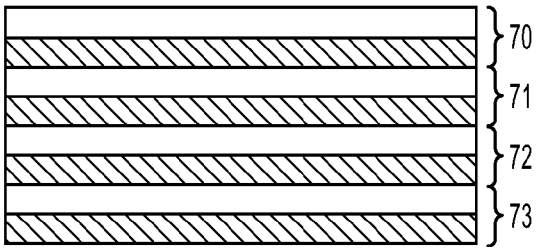
FIG. 6C shows a laminate armor structure with four layers of HHS and four elastomeric layers.

FIG. 6C shows a laminate armor structure with four layers of aluminum and four elastomeric layers. Thus, the armor structure of FIG. 6C has four bi-layers 70, 71, 72, 73, with each bi-layer having an aluminum layer and an elastomeric layer.

Figure 6D:
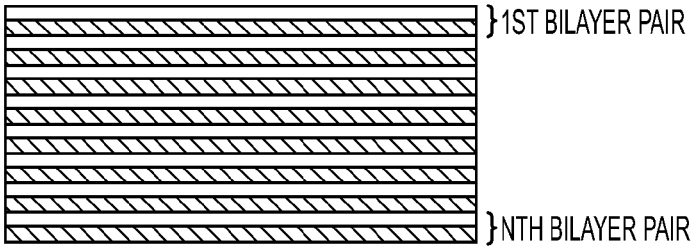
FIG. 6D is a cross sectional view of a laminate armor structure with a number of thin bi-layer pairs of alternating aluminum and elastomer.
Figure 6E:
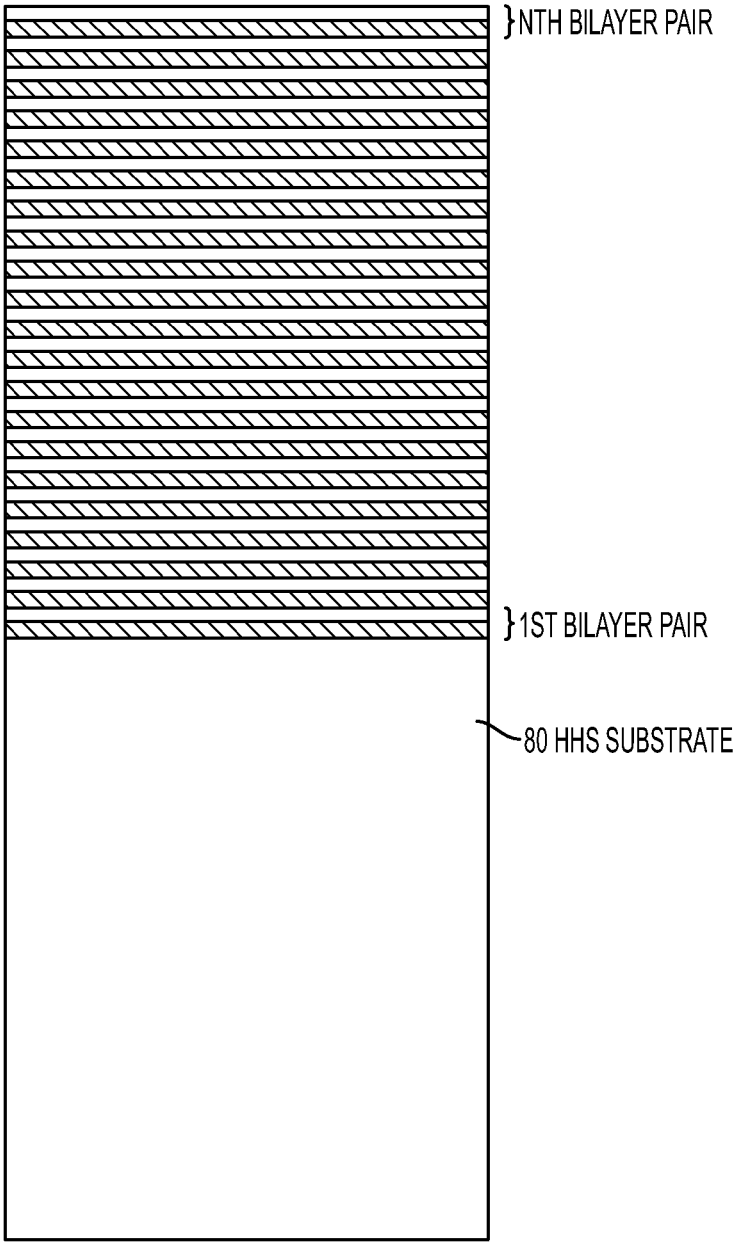
FIG. 6E shows a laminate armor structure with a HHS substrate and a coating formed of eight thin bi-layers of elastomer and aluminum plates.

FIG. 6D shows a laminate armor structure with a number of thin bi-layers, which can be applied to a HHS substrate. Generalizing, additional thinner bi-layers can be added, as shown in FIG. 6E. In this example, there are N bi-layers, with N being eight. However, it can be suitable to have fewer or more bi-layers, as discussed in more detail below.

Each of these laminate armor structures can be used in conjunction with another armor element, e.g., a metal or ceramic substrate.

FIG. 6E shows a laminate armor structure with a number of elastomeric coatings applied to a HHS substrate.

In each of these examples, the elastomeric layers are adhesively attached, mechanically affixed, or merely in physical contact with the hard layers with good surface contact at the interfaces.

It is noted that good surface contact between the elastomeric layers and the hard layers is important for good ballistic resistance. Thus, the use of woven textiles or other polymers, which have high points and low points, are suitable only if the elastomer makes intimate contact, for example by flowing against and into the fabric. Note that the fabric per se is not necessary for the V-50 performance, but may confer other property advantages.

The hard layer can be HHS, a lower hardness steel, aluminum, glass, E glass, S glass, plastic, or ceramic. Other materials can also be suitable.

FIG. 7A shows the effect of front-surface elastomer layers on the ballistic limit of steel plates by comparing a HHS target to test samples of the same weight in which the HHS is distributed over multiple bi-layers. The following examples were manufactured and tested: a single layer of 12.7 mm thick High Hard Steel; armor with a single bi-layer of HHS and elastomer, each layer being 12.7 mm thick; armor with two bi-layers of HHS and elastomer, each layer being 6.4 mm thick; and armor with four bi-layers of HHS and elastomer, each layer being 3.2 mm thick. Structures with multiple bi-layers had better penetration resistance than structures with a single bi-layer. For example, the V-50 for two bi-layers is 23% higher than a single bi-layer at equal weight. The best penetration resistance (V-50 of 1819 m/s) was measured for the sample with two bi-layers (two alternating bi-layers of 6.4 mm thick elastomer and 6.4 mm HHS). With the use of four bi-layers of equivalent total weight, there is some decrement in ballistic performance. It appears that performance improves if the substrate is thick enough to maintain enough stiffness to avoid flexure, which prevents compression of the polymer coating sufficiently rapidly to induce a glass transition. A similar effect is observed when the HHS is replaced with aluminum, with the elastomeric coating yielding much smaller increases in V-50.

In tests shown in FIG. 7B, the total mass of the target was reduced by using thinner HHS substrates. Four examples were manufactured and tested: a single layer of 12.7 mm thick HHS; armor with a single bi-layer of 12.7 mm thick HHS with one 6.4 mm thick elastomeric layer; armor with two bi-layers, each bi-layer having a 5.1 mm thick HHS layer and a 3.2 mm thick elastomer layer; and armor with two bi-layers, each bi-layer having a 5.3 mm thick HHS layer and 3.2 mm thick elastomer layer. The reduced thickness of the HHS appears to have little effect on ballistic performance. Significant increases in V-50 (1398 and 1457 m/s) compared to the bare HHS (V-50=1184 m/s) are achieved with both of the two-bi-layer armor laminates.

Multiple bi-layers of elastomer and hard material can also form the coating on a base armor substrate 80, as shown in FIG. 6E. In one armor example, a 5.3 mm thick HHS substrate was coated with bi-layers formed of alternating layers of 0.25 mm thick aluminum and 0.33 mm thick PU-1 (11 PU-1 layers and 10 aluminum layers). For comparison, another specimen was formed with a 5.3 mm thick HHS substrate coated with 21 soft PU-1 layers, having a total PU-1 thickness of 6.1 mm. Data for bare HHS and bare Rolled Homogeneous Armor substrates are shown for comparison. The specimen with alternating layers of aluminum and PU-1 was only slightly heavier than the specimen with 21 layers of PU-1. The metal/PU-1 specimen had 60% better penetration than the single layer of HHS, as shown in FIG. 7C. Note that equivalent performance from Rolled Homogeneous Armor appears to require about twice the thickness (or weight) compared to the bi-layer-laminate-coated HHS armor.

It is clear that penetration resistance is improved by applying a high molecular weight elastomer coating, and that beyond the initial thickness of ⅛ inch of coating thickness, that the penetration resistance is only weakly influenced by additional thickness. Enhancements in ballistic performance of nearly 50% have been observed with a weight increase of only one to two pounds/square foot.

Thus, lightweight armor can provide improved ballistic performance by providing bi-layers with alternating layers of stiff conventional armor material (e.g., HHS) and viscoelastic materials. Good physical contact between the layers appears to improve the ballistic performance. The armor can be formed entirely of bi-layers, or can include bi-layers on a HHS or other hard armor substrate (e.g., aluminum, ceramic, other steels). It is believed that a hard armor plate layer having a Brinell hardness in a range of 470 to 600 performs best. As the hardness of the hard layer is reduced, the enhanced performance of the polymer is reduced (assuming no changes in other properties of the steel, such as its strength or ductility). For example, an armor plate with a lower Brinell hardness between 300 and 470 is also suitable, although the performance is not as optimal as armor which includes the higher hardness layers. With lower Brinell hardness materials, it may be necessary to increase their thickness, so they are stiff enough to resist significant flexing or even buckling upon impact.

The armor can include successive layers of alternating high and low modulus materials. These materials can be distinct, such as a rigid solid, or the modulus variation can be the result of chemical variations of a given material. Examples include alternating high and low crosslink density elastomers, or alternate neat and particle reinforced elastomer layers. The particles can be carbon black, silica particles, clay, tungsten powder, or others fillers as known in the art. The following discussion of possible theoretical basis for the improved ballistic performance is provided for information, without intending to limit the scope of the appended claims.

The degree of improvement in the ballistic protection of HHS armor coated with soft elastomer is surprising and not predicted by any model.

The impact loading resulting from the arrival of a high speed projectile induces a viscoelastic transition of the rubbery polymer to the glassy state. The evidence for this transition is threefold: (i) the failure mode of the elastomer coating changes from rubbery to brittle; (ii) the impact strain rate (approximately $10^5$ $s^{-1}$) falls within the frequency range of the local segmental relaxation dispersion of the elastomer; and (iii) the ballistic limit of the laminate increases significantly, consistent with the fact that the glass transition zone of polymers is the viscoelastic regime of greatest energy dissipation.

Note that elastomeric materials that do not go through a phase transition can also be used, although materials that experience a glass transition as a result of a high speed impact appear to provide better resistance to ballistic penetration. A high speed impact is a projectile velocity that is sufficiently high that dividing by the thickness of the elastomer coating gives a value of at least 500 inverse seconds, and typically approximately 10,000 inverse seconds. This transition significantly reduces the kinetic energy of the projectile because this transition in the viscoelastic regime of polymers is associated with maximum energy absorption. Note that the phase change in the elastomer is completely reversible; after the impact the polymer is completely elastomeric (although it will have a hole where the projectile passed through).

When the elastomer-steel configuration is present as multiple layers, the viscoelastic glass transition operates in conjunction with an enforced longer path-length for the pressure wave through the dissipative rubber, due to impedance mismatching with the metal. The multiple layers present the incoming wave with repeated impedance mismatches. The consequent reflections successively attenuate the wave amplitude by virtue of the extended path length through the energy dissipative elastomer, along with spatial dispersion of the wave. In addition energy spreading is observed where a multilayer configuration is found to amplify the impact surface area. As the layers increase the energy spreading also increases. The improvement in performance for multiple layers is consistent with the data in FIG. 5, which yields an extrapolated value of V-50 at zero coating thickness that is much larger than actually measured for the bare substrate.

In addition, the resulting material may be more ductile, apparently due to a broader distribution of local relaxation times. See Song H. H., and Roe R. J., "Structural change accompanying volume change in amorphous polystyrene as studied by small and intermediate angle X-ray scattering", Macromolecules, 1987, Vol. 20, pp. 2723-32. Since locally there is an increase in hydrostatic pressure upon impact, both these effects should be operative to increase the toughness of the elastomer, contributing to greater enhancement of penetration resistance when used as a ballistic or impact coating.

The elastomeric polymer coatings can be formed in a sheet and then applied to the hard substrate, or can be formed in place on the substrate. Because direct physical contact between the elastomer and the hard layer improves the performance, the elastomer layers preferably have smooth surfaces for close contact with the surface of the hard layers. However, the shape of the armor is not limited to the flat geometry used for test purposes.

Selection of appropriate materials for the viscoelastic layers and the hard layers can be based on their acoustic impedances. For waves at normal incidence in the linear response regime, the reflection coefficient (ratio of reflected and transmitted amplitudes)

$$R = \frac{z_2 - z_1}{z_2 + z_1},$$

in which $z_2$ and $z_1$ are the impedances of the respective layers. Using a typical value for the impedance of rubber ($z_{rubber}$ is approximately $2\times10^6$ kg $m^{-2}$ $s^{-1}$), hard layers with higher acoustic impedance would give the following reflection coefficients:

| $z_{hard}/z_{rubber}$ | R |
|---|---|
| 1.22 | 10% |
| 1.5 | 20% |
| 3 | 50% |
| 7 | 75% |
| 19 | 90% |
| 50 | 92% |

Since the amplitude of the pressures waves in a ballistic event is very large, the material response is non-linear; hence, the values in the table are first-order approximations intended to serve only as a guide. However, using these as a starting point, and depending on the number of layers and their thickness, the impedance of the hard layer (which depends on the material's modulus and density) can be chosen to give the desired behavior.

The laminate armors described above perform well against blunt objects, but their performance can be improved against sharp, hardened projectiles by use of a ceramic/steel corrugated panel. The ceramic/steel corrugated panel allows the armor system to protect equally against armor piercing (AP) and armor piercing incendiary (API) rounds. These sharper tip projectiles with a hard tip can reduce the effectiveness of the elastomer/steel composite. Through the use of a corrugated panel, sharp ogive incident projectiles are rotated about their center of mass and impact the polymer sideways providing more surface area to impact the polymer coating.

Figure 8A:
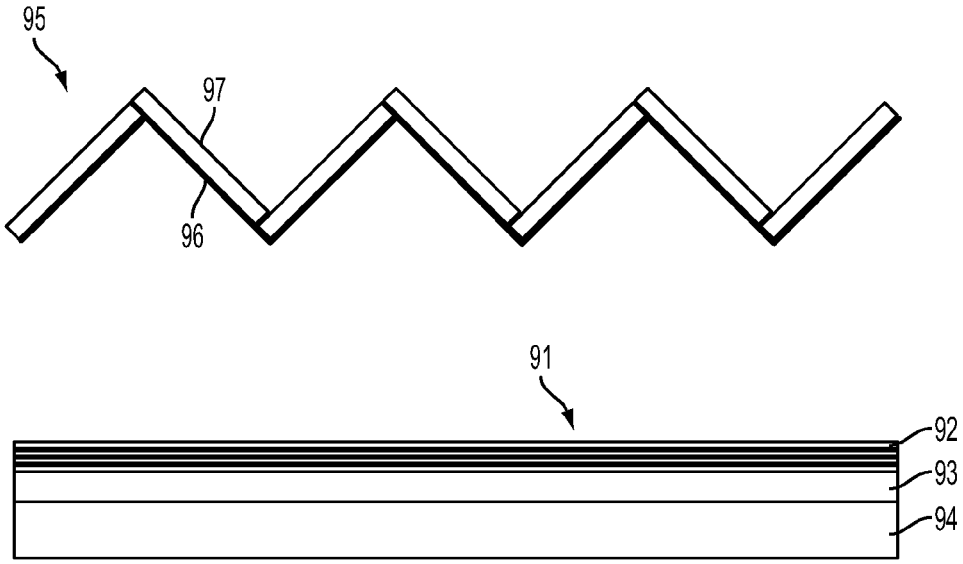
FIGS. 8A and 8B show a multilayer composite armor having both a composite laminate armor portion and a corrugated armor portion.
Figure 8B:
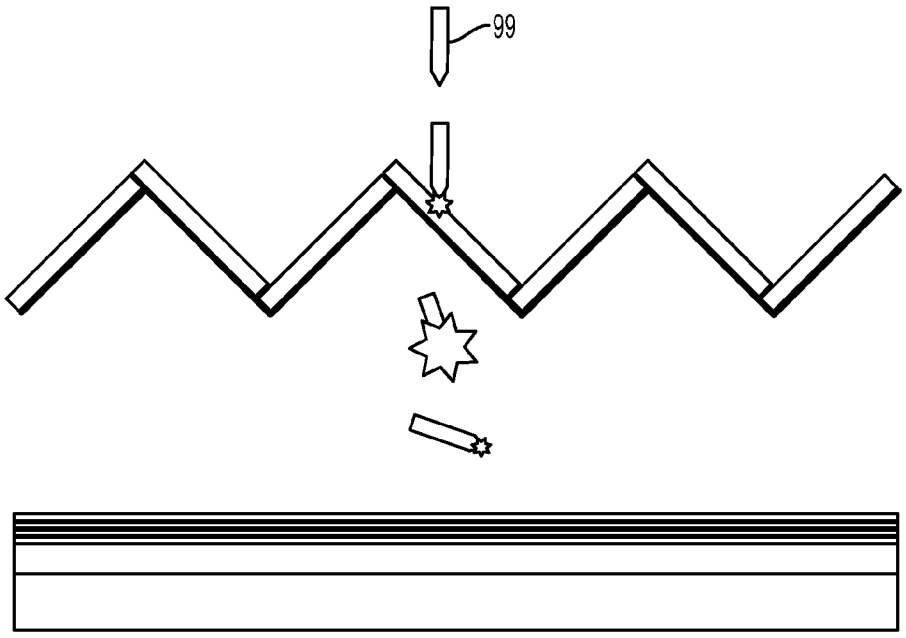

FIGS. 8A and 8B show a multilayer composite armor system 90 which includes both a laminate armor portion 91 and a corrugated panel 95. The laminate armor 91 includes a multilayer laminate 92 and a hard substrate 93 formed of a 3/16 inch thick layer of HHS, although other thicknesses and substrate materials can also be suitable. The armor 91 also includes a spall liner 94 for protecting personnel and equipment from spalling of the HHS plate. In this example, the spall liner is a ½ inch thick layer of an ultra-high-molecular-weight polyethylene (UHMWPE) gel-spun fiber material sold commercially under the trade name 50 Dyneema® by DSM, headquartered in Heerlen, Netherlands, although other materials are also suitable.

The corrugated panel 95 can be formed of a steel-ceramic laminate. For example, the panel can include corrugated 18 gauge 4140 steel 96, which has been heat treated to a hardness of Rockwell 45C, layered with ⅛" SiC ceramic panels 97, with the ceramic panels adhered to the outside of the steel panel 96. Preferably, the laminate panel 95 is off-set from the main armor structure 91 by a distance sufficient to affect the projectile path. For example, the distance between the closest point of the corrugated steel ceramic panel 95 and the main armor structure 91 can be approximately 2 inches. The laminate panel causes the projectile 99 to rotate the about its center of mass, as shown in FIG. 8B. The spacing between the corrugated panel 95 and the multi-laminate armor structure 91 causes the bullets or other projectiles to continue to rotate during flight after passage through the corrugated panel, and the tumbling projectile then encounters the multi-laminate armor structure 91 at an oblique angle, reducing its penetration effectiveness. For larger projectiles the steel and ceramic thickness will need to be increased (corrugation dimensions will also need to be increased). In addition, the corrugated steel-ceramic panel 95 can partially break up and blunt the incident projectile, affording enhanced protection against AP ammunition.

The corrugated panel 95 can be configured in various ways depending on the application. In some applications, the corrugated panel 95 can be held in place at a desired distance from the multi-laminate armor structure 91 by spacers or other structural members (not shown). In other applications, it may be suitable to allow the corrugated panel to be free of any attachment to the multi-laminate armor structure.

Due to their increased resistance to AP and API ammunition, these multilayer composite armor systems 90, which include both a laminate armor portion 91 and a corrugated panel 95, can be used as armoring on motor vehicles and for personnel protection applications, among other uses.

Figure 9A:
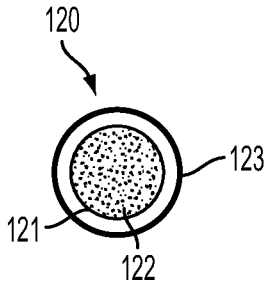
FIG. 9A, FIG. 9B, and FIG. 9C illustrate a multi-laminate armor system that includes cylindrical layers positioned in front of a composite laminate armor, with each cylinder including a compressed glass within a metal cylinder.
Figure 9B:
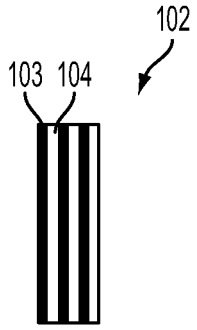
Figure 9C:
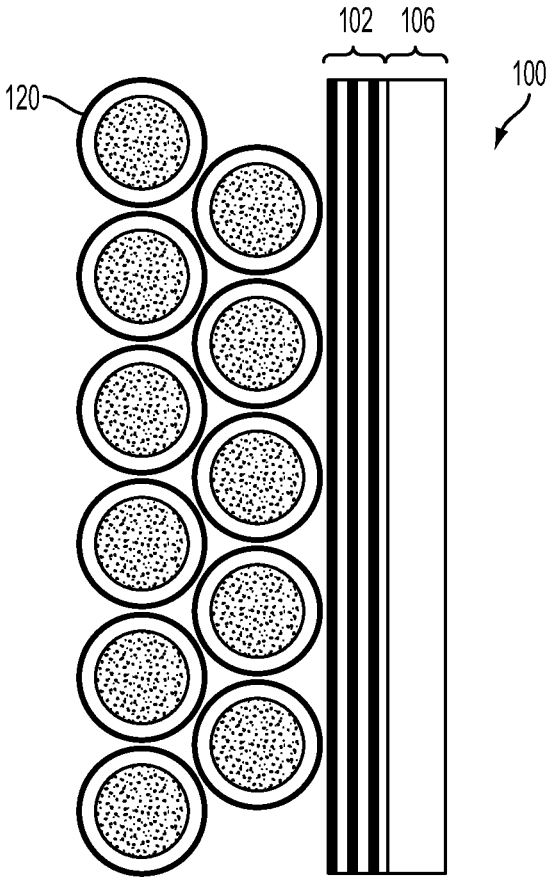

FIG. 9A, FIG. 9B, and FIG. 9C illustrate another inventive aspect of the multi-laminate armor system, intended to be a low cost, low weight armor suitable to defeat a wide range of ballistic threats, including small caliber guns, fragmentation, shape charges and explosively formed penetrators (EFP). The corrugated armor and laminates of FIGS. 9A and 9B are intended against ballistic threats generated from small caliber guns and fragmentation, while the cylindrical armor elements of FIG. 9C are believed to provide good protection against shape charge and EFPs.

Standard armor has been traditionally been constructed of steel of various hardness and thickness depending on the type of threat. Newer armor uses composite materials, for example application on the front surface of ceramics. However, these armors may not stop shape charges and explosively formed penetrators (EFPs), since these produce a stream of particles arriving at the same location.

The armor system 100 illustrated in FIG. 9C includes a composite armor panel formed of a composite laminate plate armor 102 with a with a spall liner 106. Another component of the armor system is a cylindrical armor 120 layered on the front of the plate armor.

The cylindrical armor includes several layers of cylinders, each of the cylinders being formed with ceramic, borosilicate or soda-lime glass having a high iron content. The glass is hydrostatically compressed within high strength metal cylinders. The cylinders 120 can be constructed of high strength steel (e.g., 4140 to 4340 steel hardened to approximately 50 C Rockwell hardness). During the hardening process, the steel cylinders are heated and the glass is pressed into the cylinders. Upon cooling, the cylinder compresses the glass. Endcaps are used to confine the glass, preventing flow. FIG. 9A is a side view of the cylindrical armor 120. In this example, the metal cylinder 121 is an outer 4000 series steel heat treated to Rockwell 50C. One method for forming the cylindrical armor is to heat the steel cylinder, press ceramic, borosilicate or soda-lime glass 122 into the cylinder, and screw end caps onto both ends to seal the cylinder while the steel cylinder is still hot. When cooled, the cylinder will compress the glass in all three dimensions. An outer multi-laminate coating 123 (e.g., alternating layers of viscoelastic material and steel) can be applied to the outer surface of each metal cylinder for additional penetration resistance.

Other methods of sealing the cylinder are also possible. It also suitable to form metal cylinders which have integral end caps and another sealable opening for injecting or otherwise receiving the glass or ceramic.

Alternatively, the cylindrical casings can be formed of a non-metal material, such as a polymer or resin-based composite, which typically cannot be heated to temperatures needed to soften the glass or ceramic. For the non-metal cylindrical casings, the glass or ceramic inserts would be cooled and placed into the cylinder while cool. The cylinder is then sealed, and the armor element is allowed to warm up to room temperature. As the glass expands, the cylindrical casing compresses the glass or ceramic in all three directions. One method for cooling the glass or ceramic is to chill it in liquid nitrogen, preferably in a dry environment in order to minimize frost buildup on the glass or ceramic.

The cylinders 120 will be placed in front of the plate armor 102 in at least two rows staggered by a lateral spacing equal to one half of the cylinder diameter. In one example shown in FIG. 9B, the plate armor 102 has three layers of 0.167 inch thickness HHS plates 104 and three layers of 0.167 inch thickness multi-ply laminate 103. Each multi-ply laminate includes multiple alternating layers of viscoelastic material and steel or another hard armor material.

The armor system illustrated in FIG. 9C uses multiple mechanisms to distribute and dissipate the incident energy. A primary mechanism is energy dissipation through fracture energy and recycling of the glassy material in the cylinders. When a projectile strikes the cylinder, the glass flows back into the line of flight of the incident projectiles. In addition, the obliquity of the cylindrical path allows incident projectiles to be diverted, which reduces the component of the force normal to the plate armor and increases the path length necessary for the projectile to penetrate the plate armor (penetration distance). Aspects of the design, including materials, spacing, and alignment, can be adjusted based on required threat defeat performance.

The cylindrical armor elements 120 can also be used by themselves without another armor element backing, with the laminate armor backing, with a bare metal armor backing, or in conjunction with another type of armor backing. They can also be used in a modular fashion, and added or removed from targets as needed. For example, when used in a vehicle, the cylinder armor in the present design can be attached by hangers, and can be easily removed from the vehicle. This allows the operators to reduce the overall parasitic weight when the vehicle is in lower threat conditions. This armor system may find its primary application in armor for medium and heavy military tactical vehicles against high performance threats, although many other applications are possible.

Referring again to the material layers that form the composite laminate armor element, the soft layer can alternatively be formed of materials that are not generally considered elastomers if they have suitable ductility, density, and hardness. Some materials include semi-crystalline fluoropolymers such as polytetrafluoroethylene, or "PTFE", manufactured under the tradename TEFLON®, or similar polymers that are not perfluorinated, polyvinylidene fluoride, etc. Thus, each of the laminate armor systems discussed in this specification can be formed with one or more of these polymeric materials as the soft layers in the composite laminates.

Other alternatives to the metal or ceramic layer in the laminates are believed to be able to reduce weight and still function well, depending on the performance level required (size of bullet, ball ammo or armor-piercing). One example of a suitable hard material is mica. Thus, each of the example embodiments described above can be formed with mica as the hard layer in the laminate element of the armor.

The laminate armor embodiments of U.S. application Ser. No. 13/085,130 are shown in the drawing figures with planar laminate composites. Performance improvements can be obtained by changing the geometry of the armor and by adding additional armor elements to induce obliquity in, and otherwise perturb, the incoming projectile. Several examples are shown in FIG. 10-FIG. 13 and described below.

Figure 10:
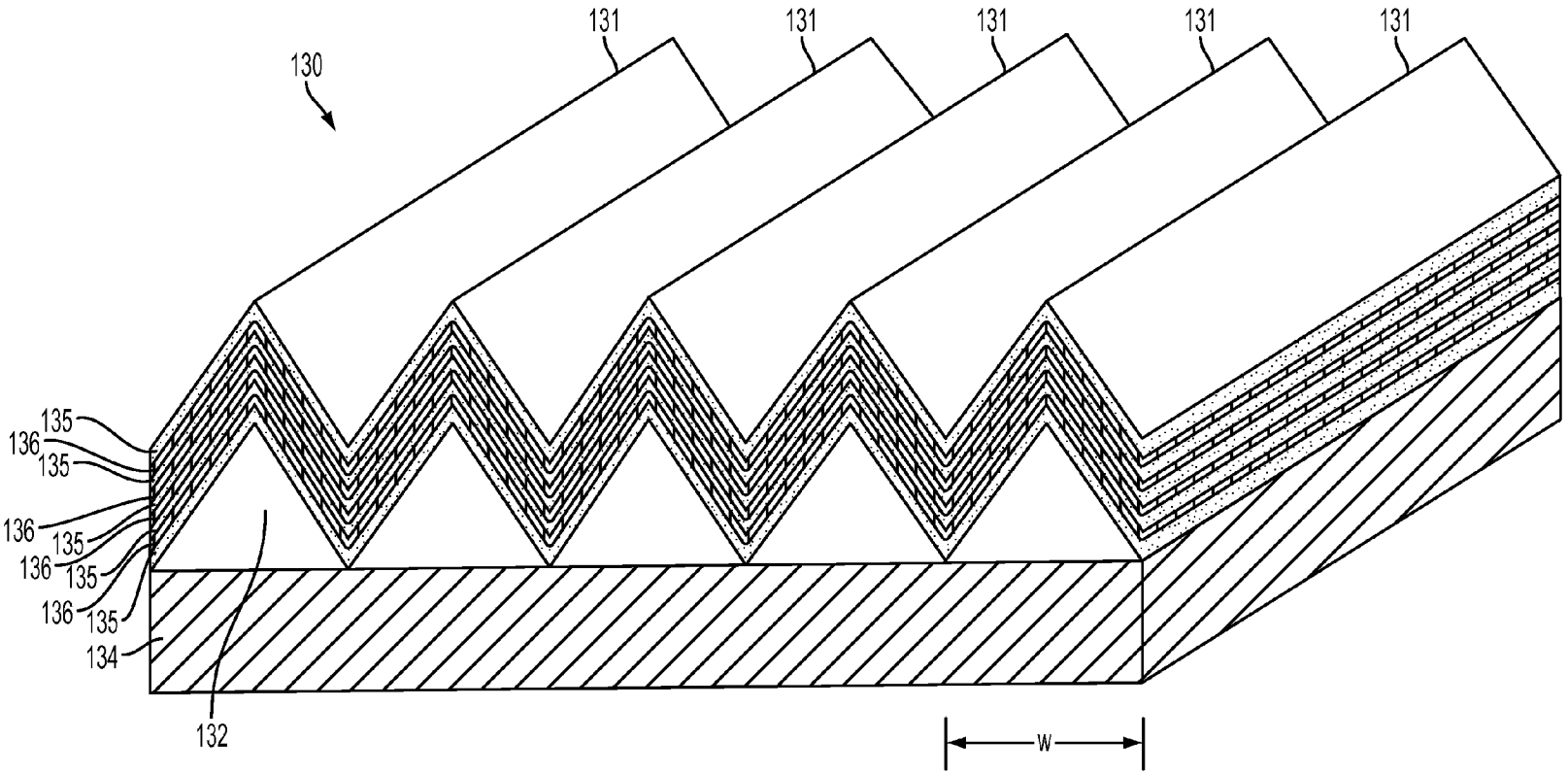
FIG. 10 illustrates a cross sectional view of a laminate armor system having an angled laminate armor element.

For example, spherical topology, grooving, and corrugation can induce obliquity in and otherwise perturb the incoming projectile. FIG. 10 illustrates a cross section of a laminate armor system 130 having a plurality of angled laminate armor elements 131. The laminate itself can be composed of the same alternating layers of hard materials 136 and soft materials 135 used in the planar laminates described above. A filler layer 132 can be added between the substrate 134 and the laminate elements 131. The filler layer 132 can be the same material as the soft layer 135, or a material with an intermediate hardness that is between the hardness of the soft layer 135 and the hardness of the hard layer 136. Examples of suitable materials for the filler material 132 include polyurea, butyl rubber, aluminum, and ultra-high-molecular-weight polyethylene (UHMWPE), such as that manufactured under the tradename Dyneema®. The number of layers in the laminate elements 131 can be varied, very similarly to planar laminate designs. The exact requirements depend on desired level of performance and the areal density. There are two main advantages to an angled laminate design: (i) the projectile experiences a torque on impact, which broadens its impact area (akin to "belly-flopping"), reducing the impact pressure; and (ii) the lack of planarity of the layers causes spatial dispersion of the pressure waves produced by internal reflections within the impedance-mismatched layers of the composite laminated layers. The angled laminate elements 131 create a corrugated surface with parallel peaks and valleys between the peaks. Each angled armor element 131 can be sized so its width w is between about 1 times and 2-3 times the diameter of the projectile the armor is designed to defeat. For example, for an armor system 130 designed to defeat a .50 caliber firearm projectile with a 0.5 inch diameter, a suitable element width w is between about 0.5 inch and about 1.5 inches. In one example, the width is ⅝ inches. Similarly, for a .30 caliber firearm projectile with a 0.3 inch diameter, a suitable element width w is between about 0.3 inch and 0.9 inches.

Figure 11A:
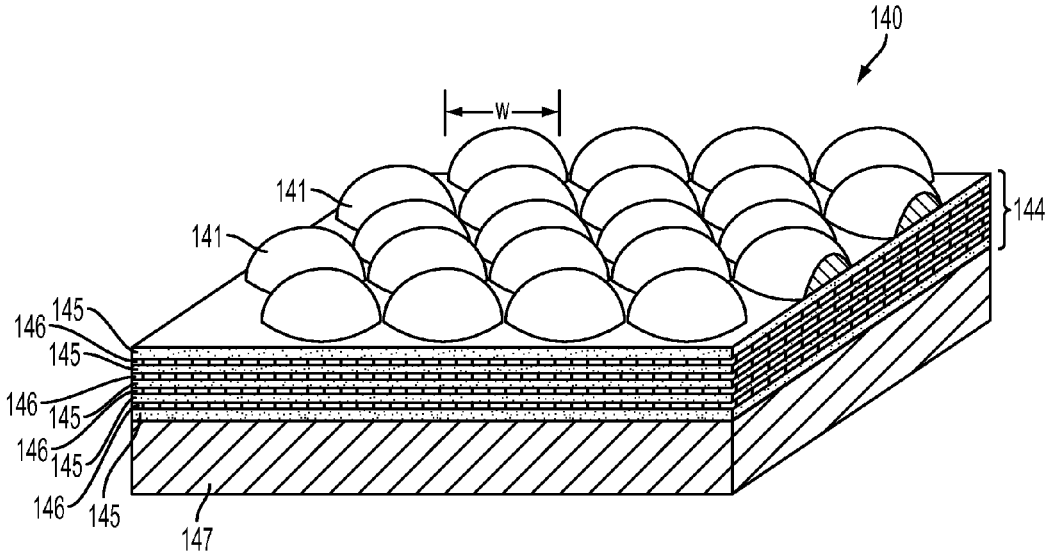
FIGS. 11A and 11B illustrate a laminate armor system with a front surface having a plurality of hemispherically shaped protrusions.

FIG. 11A illustrates a laminate armor system 140 in which the front surface 142 has a layer 143 formed of a plurality of hemispherically shaped protrusions 141 at the strike face, facing toward the incoming projectiles. In this example, the top layer 143 with hemispherical elements 141 is added to the front surface of a planar laminate 144 which may be backed by a hard substrate 147. The planar laminate 144 is formed of alternating layers of soft material 145 and hard material 146, as described in the paragraphs above related to FIG. 1-9. This layer 143 can be formed of the same material as the soft layer in the laminate 144, or can be formed of a material with an intermediate hardness between that of the soft layer and the hard layer in the laminate 144; examples of suitable materials include polyurea, butyl rubber, and even certain ceramic elements. The underlying laminate 144 can be any of the laminates described above, with the thickness, number, and material choice determined as described above in the paragraphs related to FIGS. 1-9. The size and material comprising the top layer 143 is selected based on the required performance level and the areal density of the armor. Two advantages of using a hemispherical top layer are broadening the impact area and spatially dispersing the pressure wave. In addition, when the front surface elements are formed of a material designed to fracture, abrade, or blunt the incoming projectile, the elements 141 further reduce the projectile's penetrating power.

Figure 11B:
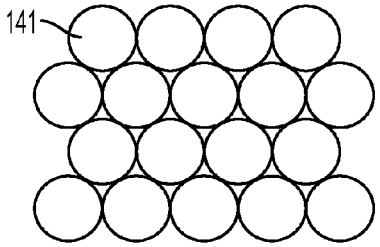

The hemispherical elements 141 can be arranged in a tightly packed hexagonal pattern such as that shown in FIG. 11B, in order to minimize the space between the hemispherical elements. Other patterns can also be suitable, however, based on specific performance requirements and weight considerations.

Figure 12A:
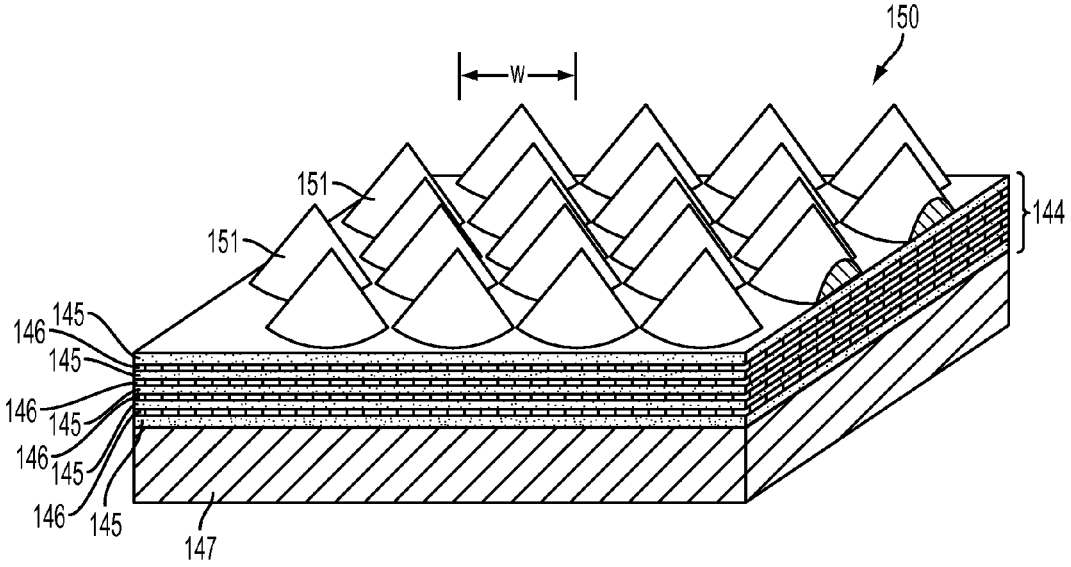
FIGS. 12A and 12B illustrate a laminate armor system with a front surface having a plurality of conically shaped protrusions.

As as shown in FIG. 12A, an armor system 150 can alternatively include an array of convex conical elements 151 positioned in front of the layers of the laminate armor 144, arranged with the apexes of the conical elements facing outward.

Each conical element 151 can be sized so its base diameter is between about 1 times and 2-3 times the diameter of the projectile the armor is designed to defeat. For example, for an armor designed to defeat a 50 caliber projectile with a 0.5 inch diameter, a suitable element diameter d is between about 0.5 inch and 1.5 inches.

Figure 12B:
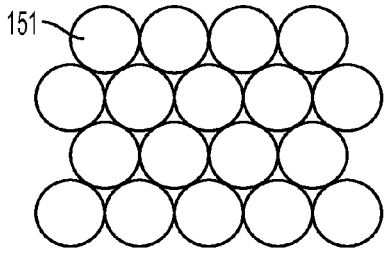

The conical elements 151 can be arranged in a tightly packed hexagonal pattern such as that shown in FIG. 12B, in order to minimize the area space between the elements. Other patterns can also be suitable, potentially reducing areal density; however, they may be less effective in resisting projectiles.

Figure 13A:
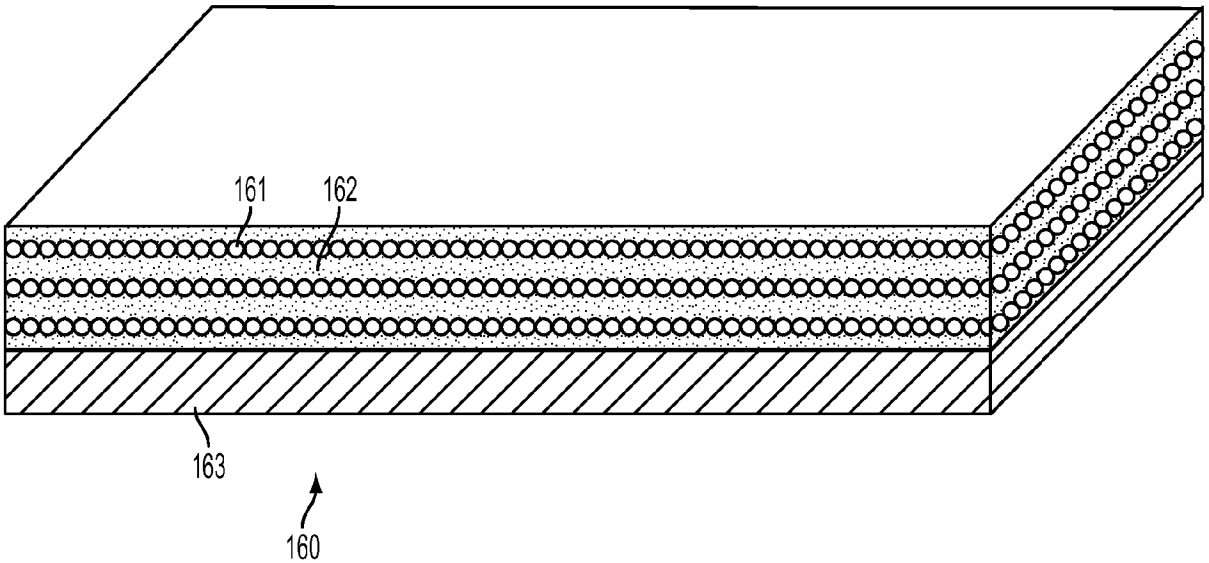
FIG. 13A is a cross sectional view of a laminar armor system in which the hard layers within the laminate are replaced by discrete particles.
Figure 13B:
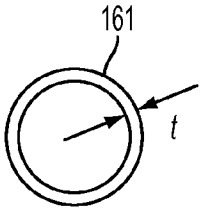
FIG. 13B is a cross sectional view of a hollow sphere that can be a discrete particle in the armor system of FIG. 13A. Separation between spheres can be from zero (touching) to a maximum equal to the sphere radius, with the value within this range selected based on the performance requirements and any need to minimize with weight.

FIG. 13A is a cross sectional view of a laminar armor system 160 in which the hard layers within the laminate are formed by a layer of discrete particles. In this example, the layer of discrete particles is a two-dimensional array of hollow spheres 161, each in contact with its neighbor, held in position by encapsulation by the softer polyurea layers 162 of the laminate. The hollow spheres can be formed of a ceramic or metal, with a wall thickness t chosen so the mass density of the spheres is approximately equal to the mass density of the soft polymer layers. In particular, for a given outer particle diameter, increasing the wall thickness for a particle increases its mass, and therefore, increases the layer's density. The laminate can be positioned in front of an armor substrate 163. The number of layers within the laminate and their thicknesses can be selected to optimize the laminate's performance.

Separation between spheres can be from zero (touching) to a maximum equal to the sphere radius, with the value within this range selected based on the performance requirements and weight restrictions. The advantages of using discrete particles include: (i) the spherical shape of the particles induces obliquity in the path of a projectile; (ii) the particles provide spatial dispersion of the pressure waves; (iii) the particles provide a reduction in the areal density of the layer compared to a solid hard armor layer; and (iv) the particles can cause fracture or abrasion of the projectile by impact on the particles (even upon fracture of the particles themselves, since encapsulation by the surrounding polymer maintains the comminuted material in the path of the incoming projectile).

Figure 14:
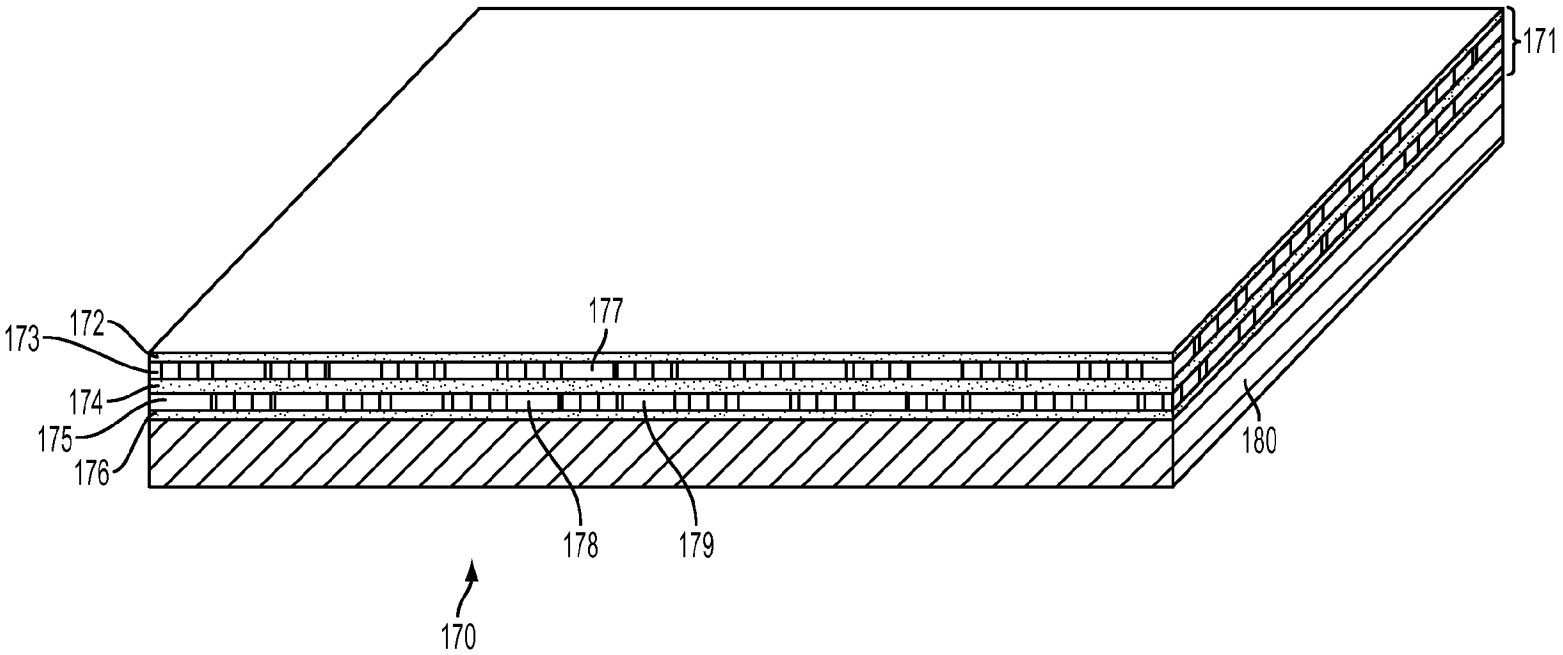
FIG. 14 illustrates a cross section of a laminate armor system in which some or all of the hard layers within the laminate are perforated.

FIG. 14 illustrates a laminate armor system 170 having a laminate 171 and a substrate 180, in which some or all of the hard layers within the laminate 171 are perforated hard layers. In this example, the perforated hard layers 173 and 175 are positioned between soft layers 172 and 174, and soft layers 174 and 176, respectively. The perforated hard layers are aligned such that perforations in successive layers do not overlap each other. For example, perforation 177 in hard layer 173 does not overlap with the nearest perforations 178 and 179 in the hard layer 175. The perforations can be empty, or can be filled with the material that forms the soft layer, thus mechanically interlocking the soft and hard layers. The usual design variables are available, including the number of layers within the laminate and their thickness. In addition, the size, shape (for example circular, elongated), orientation and amount of perforation can be varied. The advantages of using perforated layers include: (i) reduction in areal density; (ii) increased resistance to delamination due to interlocking of hard and soft layers; (iii) induced obliquity in the projectile; (iv) an increase in lateral dispersion of the pressure waves.

Each of the armor systems can also include a spall liner at the inner side of the plate for protecting personnel and equipment from spalling of the hard armor components. For embodiments having a composite laminate armor portion, the spall liner can be in addition to the at least two-bilayers that form the composite laminate armor portion. An example of a suitable spall liner is a ½ inch thick layer of an ultra-high-molecular-weight polyethylene (UHMWPE) gel-spun fiber material sold commercially under the trade name 50 Dyneema® by DSM, headquartered in Heerlen, Netherlands, although other materials are also suitable.

Many embodiments of the invention can be made without departing from the spirit and scope of the invention, with the invention residing in the claims hereinafter appended.

What is claimed as new and desired to be protected by Letters Patent of the United States is:

1. An armor system comprising:

a composite laminate with at least four alternating layers of a first viscoelastomeric material and a second material, the first viscoelastomeric material having a lower acoustic impedance than the second material, the second material being harder than the first material; and a front layer arranged at a front surface of the composite laminate, the front layer formed of a viscoelastomeric material with a lower acoustic impedance than the second material and having a non-uniform thickness with a plurality of convex protrusions facing away from the composite laminate and having a substantially planar rear surface in contact with the composite laminate.

2. The system of claim 1, wherein the protrusions have a hemispherical shape.

3. The system of claim 1, wherein the protrusions have a conical shape.

4. The system of claim 1, wherein the front layer is formed of the same viscoelastomeric material as the first viscoelastomeric material.

5. The armor system according to claim 1, further comprising: a hard substrate positioned at a rear surface of the composite laminate.

6. The armor system according to claim 5, wherein a layer of the first viscoelastomeric material is in contact with the hard substrate.

7. The armor system according to claim 5, wherein the first viscoelastomeric material comprises polyurea.

8. The armor system according to claim 5, first viscoelastomeric material comprises butyl rubber.

9. The armor system according to claim 1, wherein the first viscoelastomeric material comprises polyurea.

10. The armor system according to claim 1, first viscoelastomeric material comprises butyl rubber.

* * * * *